US006730140B2

(12) United States Patent
Lageson et al.

(10) Patent No.: US 6,730,140 B2
(45) Date of Patent: May 4, 2004

(54) INTEGRALLY MOLDED BRUSH AND METHOD OF MAKING THE SAME

(75) Inventors: Kent E. Lageson, Savage, MN (US); Yvonne I. Lund, Cottage Grove, MN (US); Brent D. Niccum, North St. Paul, MN (US); Carole A. Tronnes, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 73 days.

(21) Appl. No.: 10/087,300

(22) Filed: Feb. 4, 2002

(65) Prior Publication Data

US 2002/0132572 A1 Sep. 19, 2002

Related U.S. Application Data

(62) Division of application No. 09/419,253, filed on Oct. 15, 1999, now Pat. No. 6,422,932.

(51) Int. Cl.[7] ..... B24D 11/00; B29C 45/00

(52) U.S. Cl. ..... 51/298; 264/328.1; 264/328.14; 264/328.16; 264/328.18; 264/330

(58) Field of Search ..... 51/293, 298, 307, 51/308, 309; 264/239, 328.1, 328.8, 328.14, 328.16, 328.17, 328.18, 330

(56) References Cited

U.S. PATENT DOCUMENTS

| | | | |
|---|---|---|---|
| 2,682,734 | A | 7/1954 | Peterson |
| 2,826,776 | A | 3/1958 | Peterson |
| 2,845,648 | A | 8/1958 | Peterson |
| 2,878,048 | A | 3/1959 | Peterson |
| 3,016,554 | A | 1/1962 | Peterson |
| 3,076,219 | A | 2/1963 | Peterson |
| 3,307,213 | A | 3/1967 | Schofield |
| 3,325,846 | A | 6/1967 | Goss |
| 3,353,200 | A | 11/1967 | Charvat |

(List continued on next page.)

FOREIGN PATENT DOCUMENTS

| | | |
|---|---|---|
| WO | WO 95/23539 | 9/1995 |

OTHER PUBLICATIONS

Brochure entitled *Fladder®System*, Hansen & Hundebol, Inc., Atlanta, GA; 1993, no month.

(List continued on next page.)

*Primary Examiner*—Michael Marcheschi
(74) *Attorney, Agent, or Firm*—Gary L. Griswold; Rick L. Franzen

(57) ABSTRACT

An integrally molded brush. A preferred embodiment of the integrally molded brush includes a) a generally planar hub having an outer periphery, where the hub has a thickness of at least 0.05 inches; and b) a plurality of bristles extending from the outer periphery of the hub, where each of the bristles includes a bristle tip opposite the hub, where the bristle tip has a thickness up to 0.03 inches, and where the molded brush comprises a thermoplastic polymeric material. The present invention also provides a method of molding an integrally molded brush. A preferred embodiment of the method includes the steps of: a) heating a thermoplastic polymer to allow the thermoplastic polymer to be injected into a mold; b) injecting the thermoplastic polymer into a mold, wherein the mold includes a hub section and a plurality of bristle sections in fluid communication with the hub section, where the bristle tip section has a thickness up to 0.03 inches; c) injecting the thermoplastic polymer into the hub section of the mold, while maintaining the thermoplastic polymer at a high enough temperature to prevent solidification of the thermoplastic polymer; d) injecting the thermoplastic polymer into the plurality of bristle sections of the mold so as to substantially fill the plurality of bristle sections with the thermoplastic polymer; e) sufficiently cooling the thermoplastic; and f) thereafter removing the integrally molded brush from the mold.

3 Claims, 6 Drawing Sheets

U.S. PATENT DOCUMENTS

| | | | | | |
|---|---|---|---|---|---|
| 4,945,687 | A | | 8/1990 | Scheider et al. | |
| 5,016,311 | A | | 5/1991 | Young et al. | |
| 5,083,840 | A | | 1/1992 | Young et al. | |
| 5,129,191 | A | | 7/1992 | Warner et al. | |
| 5,170,593 | A | | 12/1992 | Tyler et al. | |
| 5,187,904 | A | | 2/1993 | Tyler et al. | |
| 5,233,719 | A | | 8/1993 | Young et al. | |
| 5,329,730 | A | | 7/1994 | Scheider et al. | |
| 5,427,595 | A | | 6/1995 | Pihl et al. | |
| 5,443,906 | A | | 8/1995 | Pihl et al. | |
| 5,460,883 | A | | 10/1995 | Barber, Jr. et al. | |
| D378,004 | S | | 2/1997 | Wilson et al. | |
| 5,679,067 | A | * | 10/1997 | Johnson et al. | 451/527 |
| 5,736,084 | A | * | 4/1998 | Uchida et al. | 264/112 |
| 5,903,951 | A | | 5/1999 | Ionta et al. | |
| 5,938,988 | A | * | 8/1999 | Lust et al. | 264/2.5 |
| D424,765 | S | | 5/2000 | Lund et al. | |
| 6,136,143 | A | | 10/2000 | Winter et al. | |

OTHER PUBLICATIONS

Brochure entitled *Radial Bristle Discs*, 3M Canada, 1998, no month.

Technical Paper entitled *Developing and Emerging Trends in Brushing and Buffing*, Alfred F. Scheider, Society of Manufacturing Engineers, SME No. MR83–682, 1983, no month.

*Thermoplastic Elastomers: A Comprehensive Review* edited by N.R. Legge, G. Holden and H.E. Schroeder; Hanser Publishers, New York, 1987, no month.

Technical Paper entitled *Advancements in Flexible Abrasive Finishing Tools*, Joseph Gaser, Society of Manufacturing Engineers, SME No. MR93–135, 1993, no month.

Technical Paper entitled *Applications with Abrasive Nylon Filament Tools*, Joseph Gaser, Society of Manufacturing Engineers, SME No. MR93–326, 1993, no month.

Technical Paper entitled *Abrasive Monofilmanets—Critical Factors that Affect Brush Tool Performance*, Society of Manufacturing Engineers, SME No. MR88–138, 1988, no month.

Brochure entitled *Wolfhead Sanding and Polishing Wheels*, Bulletin W–3 Grinding & Polishing Machinery Corporation, Indianapolis, IN; Oct. 1988, no month.

* cited by examiner

INTEGRALLY MOLDED BRUSH AND METHOD OF MAKING THE SAME

CROSS REFERENCE TO RELATED APPLICATIONS

This application is a divisional of U.S. application Ser. No. 09/419,253, filed Oct. 15 1999 U.S. Pat. No. 6,422,932.

TECHNICAL FIELD

The present invention relates generally to an integrally molded brush having a plurality of bristles extending from a generally planar hub and to a method of molding an integrally molded brush. The present invention relates more particularly to an integrally molded brush comprising thermoplastic polymeric material having a generally planar hub with a thickness of at least 0.050 inches (0.13 cm.) and a plurality of bristles with bristle tip thickness of up to 0.030 inches (0.076 cm.).

BACKGROUND OF THE INVENTION

Brushes have been used for many years to polish, clean, and abrade a wide variety of substrates. These brush products typically have a plurality of bristles that contact the substrate. Abrasive particles can be added to bristles to increase their aggressiveness. There are many manufacturing steps necessary to manufacture a conventional abrasive brush having bristles that contain abrasive particles. A mixture of abrasive particles and a thermoplastic binder may be combined and then extruded to form a bristle. The bristle is then cut to the desired length. A plurality of these bristles are then mechanically combined to form a brush segment. Next, a plurality of these brush segments may be installed on a hub or plate to form a brush.

Another example of a brush is disclosed in U.S. Pat. No. 5,903,951, "Molded Brush Segment," (Ionta et al.). In Ionta et al., a brush segment is integrally molded having a plurality of bristles extending from a generally planar center portion. The brush segment is molded from a moldable polymer such as a thermoset polymer, thermoplastic polymer, or thermoplastic elastomer. The moldable polymer preferably includes a plurality of organic or inorganic abrasive particles interspersed throughout at least the bristles, and can be interspersed throughout the brush segment. The molded brush segments can be generally circular, with the bristles extending radially outward in the plane defined by the central portion. A plurality of brush segments can be combined to form a brush assembly. Ionta et al. also discloses a method of making a molded abrasive brush and a method of refining a workpiece surface with a molded abrasive brush.

Although the commercial success of available integrally molded brushes comprising thermoplastic polymeric material has been impressive, it is desirable to further minimize the thickness of the bristle tips. Such bristles can be used, for example, to abrade small grooves, such as threads on bolts. However, it has been very difficult to integrally mold a brush with such thin bristle tips because of the tendency of the molten thermoplastic polymeric material to solidify in the mold cavity before substantially filling the bristle portions of the mold.

SUMMARY OF THE INVENTION

The present invention provides an integrally molded brush and method for making the same. One aspect of the present invention provides an integrally molded brush. The integrally molded brush comprises: a) a generally planar hub having an outer periphery, where the hub has a thickness of at least 0.05 inches; and b) a plurality of bristles extending from the outer periphery of the hub, where each of the bristles includes a bristle tip opposite the hub, where the bristle tip has a thickness up to 0.03 inches, where the molded brush comprises a thermoplastic polymeric material.

In one preferred embodiment of the above molded brush, the plurality of bristles are arranged in at least two rows extending from the outer periphery of the hub. In another aspect of this embodiment, the plurality of bristles are arranged in at least three rows extending from the outer periphery of the hub.

In another preferred embodiment of the above molded brush, the hub has a thickness of at least 0.06 inches, and where the bristle tip has a thickness up to 0.02 inches. In another preferred embodiment of the above molded brush, the hub has a thickness of 0.05 inches to 0.09 inches, and where the bristle tip has a thickness of 0.015 inches to 0.03 inches. In yet another preferred embodiment of the above molded brush, the outer periphery of the hub includes a diameter of 1.5 inches to 6.0 inches. In another preferred embodiment of the above molded brush, the hub further includes an inner periphery opposite the outer periphery, and where the inner periphery includes a diameter of 0.5 inches to 4 inches.

In another preferred embodiment of the above molded brush, each of the bristles includes a bristle length, and where the bristle length of 0.25 inches to 2.5 inches. In another preferred embodiment of the above molded brush, the brush includes a diameter of 6 inches to 8 inches. In yet another preferred embodiment of the above molded brush, each of the bristles includes a taper so as to be thicker adjacent the hub than at the bristle tip. In another preferred embodiment of the above molded brush, each of the bristles includes a bristle root adjacent the outer periphery of the center portion, where the bristle root includes a bristle thickness of 0.02 inches to 0.108 inches.

In yet another preferred embodiment of the above molded brush, the molded brush comprises a thermoplastic elastomer. In another preferred embodiment of the above molded brush, the molded brush includes abrasive particles interspersed in the thermoplastic polymeric material.

Another aspect of the present invention provides an alternative integrally molded brush. The integrally molded brush comprises: a) a generally planar hub having an outer periphery and an inner periphery opposite the outer periphery, where the hub has a thickness of 0.05 inches to 0.09 inches, where the outer periphery of the hub includes a diameter of 1.5 inches to 6 inches, where the inner periphery includes a diameter of 0.5 inches to 4 inches; and b) a plurality of bristles extending from the outer periphery of the hub, where each of the bristles includes a bristle tip opposite the hub, where the bristle tip has a thickness of 0.015 inches to 0.03 inches, where each of the bristles includes a bristle length, where the bristle length is in the range of 0.25 inches to 2.5 inches, and where each of the bristles includes a taper so as to be thicker adjacent the hub than at the bristle tip, where the molded brush comprises a thermoplastic elastomer, and where the molded brush includes abrasive particles in throughout the thermoplastic elastomer.

Another aspect of the present invention provides a method of molding an integrally molded brush. The method of molding an integrally molded brush, comprises the steps of: a) heating a thermoplastic polymer to sufficiently high temperature to allow the thermoplastic polymer to be injected into a mold; b) injecting the thermoplastic polymer under pressure into a mold, where the mold includes a hub section and a plurality of bristle sections in fluid communication with the hub section, where the hub section includes a thickness of at least 0.05 inches, where each of the bristle sections includes a bristle tip section opposite the hub section, and where the bristle tip section has a thickness up to 0.03 inches; c) injecting the thermoplastic polymer under pressure into the hub section of the mold, while maintaining the thermoplastic polymer at a high enough temperature to prevent solidification of the thermoplastic polymer; d) injecting the thermoplastic polymer under pressure into the plurality of bristle sections of the mold so as to substantially fill the plurality of bristle sections with the thermoplastic polymer; e) sufficiently cooling the thermoplastic polymer to allow the integrally molded brush to be removed from the mold; f) thereafter removing the integrally molded brush from the mold.

In another preferred embodiment of the above method, the mold includes a plurality of gates, and where the gates are in fluid communication with the hub section of the mold, and where the plurality of bristle sections extend from the hub section of the mold opposite the plurality of gates. In yet another preferred embodiment of the above method, the thermoplastic polymer includes abrasive particles therein.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE INVENTION

The present invention pertains to an integrally molded brush, and in particular, an integrally molded brush including a hub having a sufficient thickness such that during molding, the molten material is able to be injected through the hub and then into very thin bristles. In one preferred embodiment, the hub has a thickness of at least 0.050 inches (0.127 cm) to allow molding bristles having a thickness up to 0.030 inches (0.076 cm). The integrally molded brush is configured to abrade small grooves. The present invention also provides a method for molding an integrally molded brush.

Figure 1:
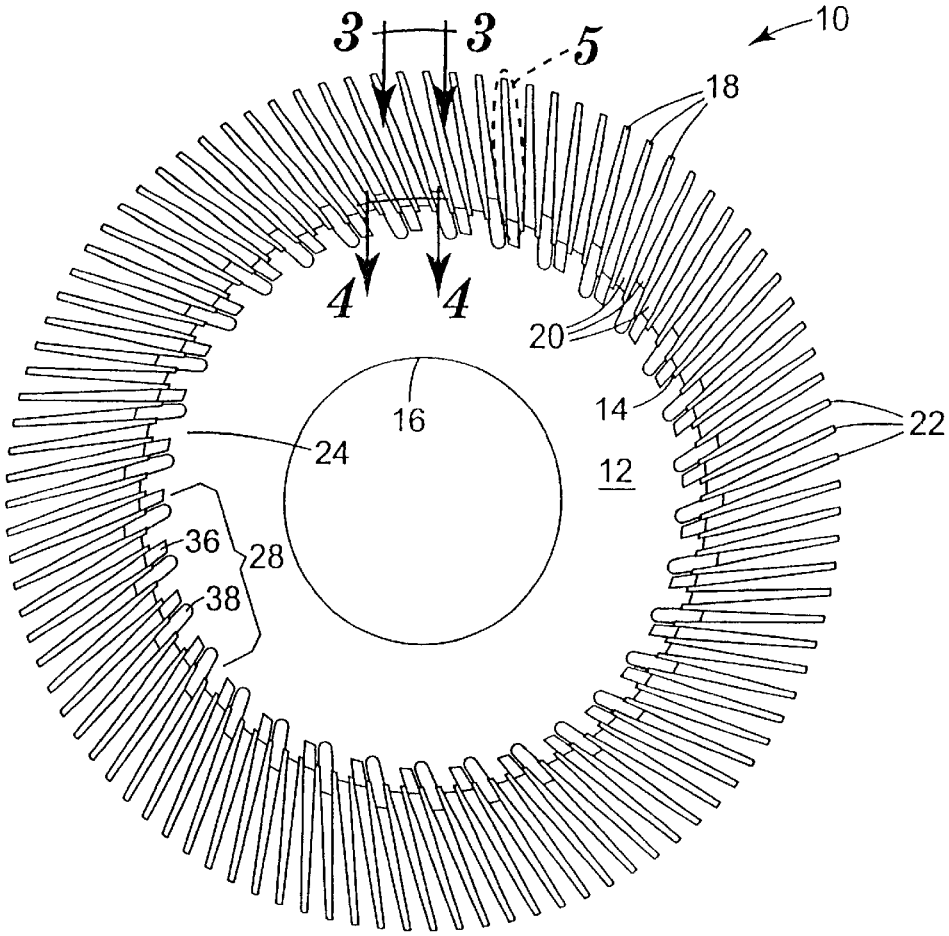
FIG. 1 is a plan view of a first embodiment of an integrally molded brush according to the present invention.

FIG. 1 illustrates one preferred embodiment of the integrally molded brush 10 of the present invention. Brush 10 includes a generally planar hub 12 and bristles 18 extending from the hub. The hub includes a first major surface 24 and a second major surface (not shown). The hub 12 also includes an outer periphery 14 and an inner periphery 16 opposite the outer periphery. The outer periphery 14 extends between the first major surface 24 and the second major surface (not shown). The inner periphery 16 extends between the first major surface 24 and the second major surface (not shown). Preferably, the outer periphery 14 and inner periphery 16 are circular, however this is not required. Brush 10 may be mounted on a suitable rotary drive using the hole bounded by inner periphery 16. As the brush 10 is rotated, the bristles 18 contact a workpiece and collectively refine the workpiece surface by: removing a portion of the workpiece surface; imparting a surface finish to the workpiece; cleaning the workpiece surface, including removing paint or other coatings, gasket material, corrosion, or other foreign material; or some combination of the foregoing.

The bristles 18 project outwardly from outer periphery 14, beginning at bristle roots 20 and ending at bristle tips 22. There may be spaces between bristle roots 20 in which outer periphery 14 of the hub 12 is exposed. Alternatively, adjacent bristles may adjoin one another at roots 20. Brush 10 is integrally molded such that bristles 18 and hub 12 are continuous with one another. Bristles 18 may extend generally radially from the outer periphery 14, or may be angled to either side of a radius. Bristles 18 may be straight or curved. In the illustrated embodiment, bristles are angled backwards from a radial line relative to the intended direction of rotation. Instead, the bristles may be angled forward. The bristles are illustrated as being in the plane of the hub 12. Instead, the bristles may be oblique to the hub, that is angling above or below the plane of the hub.

The first major surface 24 of brush 10 optionally includes an interlocking section 28, and is adjacent the outer periphery 14 in one preferred embodiment. The interlocking section 28 includes a patter of raised protrusions 36 and lowered recesses 38 relative to the first major surface 24. The second major surface (not shown) also optionally includes an interlocking section 28 opposite the interlocking section 28 on the first major surface 24. This arrangement allows two brushes 10 to interlock together by connecting their respective interlocking sections 28. Alternatively, any number of brushes 10 may be interlocked together to provide a brush assembly.

Figure 2:
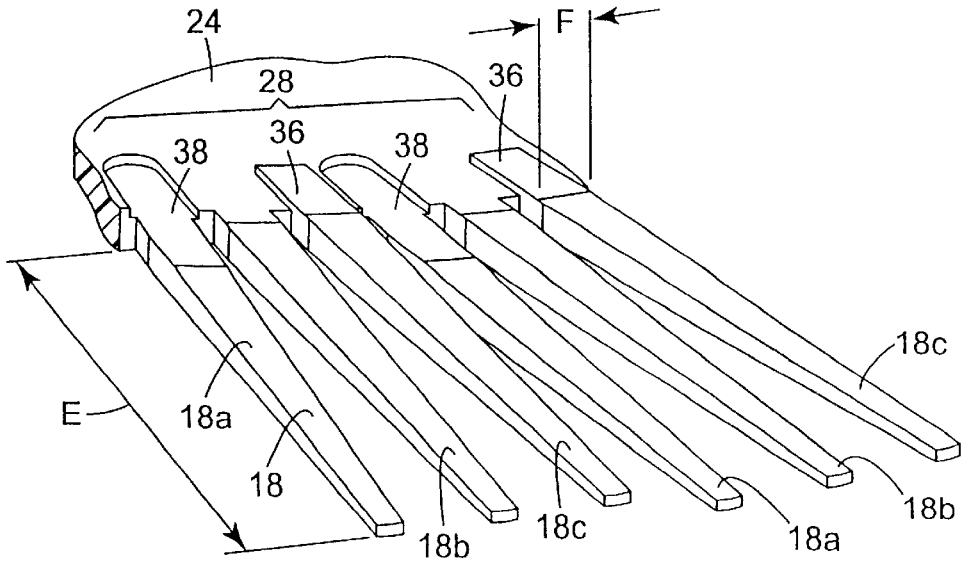
FIG. 2 is an enlarged view of the bristles and hub of the integrally molded brush of FIG. 1.
Figure 3:
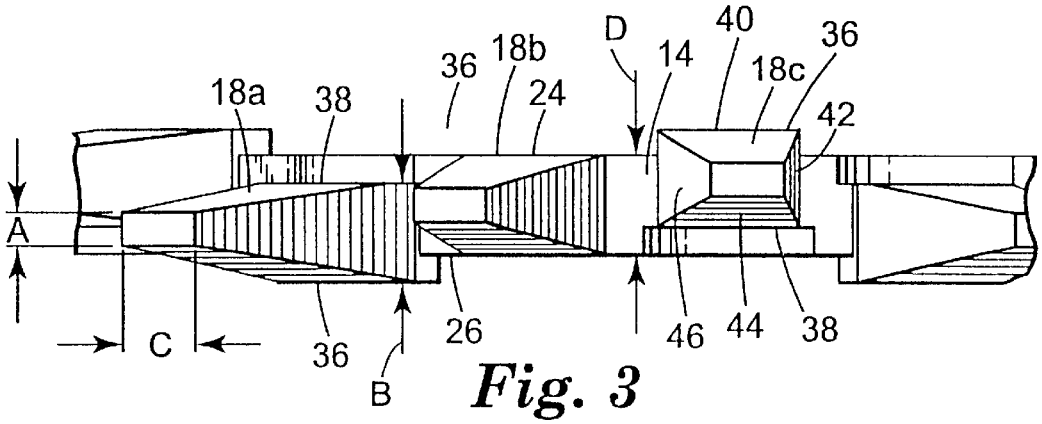
FIG. 3 is a side plan view of the integrally molded brush taken along line 3—3 of FIG. 1.

FIGS. 2 and 3 are convenient for explaining the interlocking section 28, the arrangement of bristles 18 in rows, and the geometry of the bristles 18. The interlocking section 28 is made of a series of protrusions 36 and recesses 38. The protrusions 36 and recesses 38 are aligned with bristles 18 and arranged in a pattern around the first major surface 24 adjacent the outer periphery 14 of the hub 12. For example, recess 38 is aligned with first bristle 18*a*, the first major surface 24 extends to the second bristle 18*b*, and protrusion 36 is aligned with third bristle 18*c*. This arrangement continues with the next three bristles, 18*a*, 18*b*, and 18*c*. The interlocking section 28 on the second major surface 26 of the hub 12 follows a similar pattern. On the second major surface 26, protrusion 36 is aligned with first bristle 18*a*, second major surface 26 extends to bristle 18*b*, and recess 38 is aligned with bristle 18*c*. The arrangement is such that protrusions 36 and recesses 38 are opposite one another on the major surfaces 24, 26. Also, the shape of the protrusions 36 and shape of the recesses 38 are such that the protrusions 36 of a first brush 10 closely engage with the recesses 38 of a second brush 10 and vice versa. Once two brushes 10 are interlocked by their interlocking sections 28, they may rotate together, providing a larger plurality of bristles 18 for abrading a work piece.

In this first embodiment of brush 10, the bristles 18 are preferably arranged in three rows around outer periphery 14 of hub 12. The first bristles 18*a* form a first row of bristles around outer periphery 14 of the hub 10. The second bristles 18*b* form a second row of bristles around outer periphery 14 of the hub 10. The third bristles 18*c* form a third row of bristles around outer periphery 14 of the hub 10. The first bristles 18*a* extend from the outer periphery 14 with a portion of the bristle root 20 extending below the second major surface 26 of the hub 12. The second bristles 18*b* extend from approximately the middle of outer periphery 14 of the hub 12, centered between the first and second major surfaces 24, 26 of the hub 12. The third bristles 18*c* extend from the outer periphery 14 with a portion of the bristle root 20 extending above the first majors surface 24 of the hub 12. More or less than three rows of bristles 18 may be used.

The ability to successfully mold the integrally molded brush depends in part on the geometry of the hub 12 and bristles 18. Preferably, the outer diameter of brush 10 ranges from 6 inches (15.24 cm.) to 8 inches (20.32 cm.) Preferred dimensions for the bristle tip thickness ("A"), bristle root thickness ("B"), bristle tip width ("C"), hub thickness ("D"), bristle length ("E"), bristle root width ("F"), diameter of outer periphery 14, and diameter of inner periphery 16 are included in Table 1 below:

Each range of the dimensions above, while applying to the individual dimension, needs to be selected in light of other chosen dimensions. For example, the bristle root thickness may be 0.02 to 0.108 inches (0.051 to 0.274 cm.) and the bristle root width may be 0.020 to 0.15 in. (0.051 to 0.381 cm.), but its preferable to not to have a thicker bristle with a narrower width.

The bristles 18 are illustrated as having four major surfaces 40, 42, 44, 46, however this is not required. Other cross-sections are included in the invention, such as, but not limited to, squares, circles or other shapes. In the preferred embodiment that is illustrated, individual bristles include a first surface 40, a second surface 42 adjacent the first surface 40, a third surface 44 opposite the first surface 40, and a fourth surface 46 opposite the second surface 42 and adjacent the first surface 40.

Figure 4:
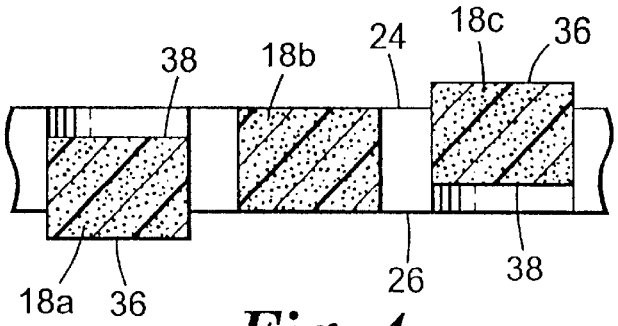
FIG. 4 is a cross-sectional view of the integrally molded brush taken along line 4—4 of FIG. 1.
Figure 5:
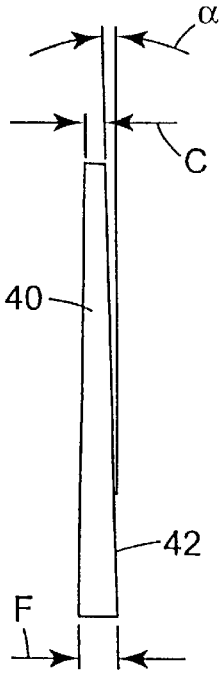
FIG. 5 is a top plan view of a bristle of FIG. 1.

Bristles 18 may be tapered. All four surfaces 40, 42, 44, 46 are illustrated as tapered, such that the cross sectional area of the bristle decreases in the direction away from the bristle root 20 towards the bristle tip 22. The angles of taper $\alpha$, $\beta$, are illustrated in FIGS. 4 and 5. However, it is not required that all the surfaces of the bristle are tapered. For instance, only second surface 42 and fourth surface 46 may be tapered. The bristles 18 are preferably tapered because the bristles are subjected to bending stresses as brush 10 is rotated against a workpiece. These bending stresses are highest at the root 20 of bristles 18 at outer periphery 14. Therefore, a tapered bristle is more able to resist bending stresses than a bristle of constant cross sectional area. Bristles 18 can have a taper along the entire length, or can have a tapered portion adjacent the root 20 and a constant cross sectional area for the remainder of the bristle. The taper can comprise any suitable angle. Preferred angles are discussed below. Furthermore, brush 10 can include a fillet radius at the transition between root 20 of bristle 18 and outer periphery 14 of hub 12.

FIG. 4 is a cross-sectional view of the bristles 18 adjacent the hub 12. In this embodiment, the bristles 18 are arranged in three rows across the thickness of the hub 12, as discussed above. The first bristle 18*a* extends from the outer periphery 14 with a portion of the bristle root 20 extending below the second major surface 26 of the hub 12. The first surface 40 of the first bristle 18*a* is coextensive with the recess 38 on the first major surface 24 of the hub 12. The third surface 44 of the first bristle 18*a* is coextensive with the protrusion 36

TABLE 1

| A | B | C | D | E | F | diameter of outer periphery | diameter of inner periphery |
|---|---|---|---|---|---|---|---|
| 0.015–0.030 in. (0.038–0.076 cm.) | 0.020–0.108 in. (0.051–0.274 cm.) | 0.015–0.070 in. (0.031–0.18 cm.) | 0.045–0.090 in. (0.1143–0.2286 cm.) | 0.25–2.5 in. (0.64–6.35 cm.) | 0.020–0.15 in. (0.051–0.381 cm.) | 1.5–6.0 in. (3.8–15.2 cm.) | 0.50–4.0 in. (1.3–10.2 cm.) |
| 0.017–0.025 in. (0.043–0.064 cm.) | 0.055–0.075 in. (0.14–0.19 cm.) | 0.020–0.055 in. (0.051–0.14 cm.) | 0.050–0.065 in. (0.13–0.17 cm.) | 0.50–2.0 in. (1.27–5.08 cm.) | 0.055–0.125 in. (0.14–0.32 cm.) | 2.0–4.0 in. (5.18–10.16 cm.) | 0.63–3.0 in. (1.59–7.6 cm.) |
| 0.018–0.023 in. (0.046–0.058 cm.) | 0.060–0.065 in. (0.15–0.17 cm.) | 0.030–0.045 in. (0.076–0.11 cm.) | 0.057–0.063 in. (0.145–0.160 cm.) | 1.0–1.5 in. (2.54–3.81 cm.) | 0.060–0.108 in. (0.15–0.274 cm.) | 3.1–3.75 in. (7.87–9.53 cm.) | 1.0–2.0 in. (2.54–5.08 cm.) |

on the second major surface 26 of the hub 12. The second bristle 18*b* extends from approximately the middle of outer periphery 14 of the hub 12, centered between the first and second major surfaces 24, 26 of the hub 12. The first surface 40 of the second bristle 18*b* extends from the first major surface 24 of the hub 12. The third surface 44 of the second bristle 18*b* extends from the second major surface 26 of the hub 12. The third bristle 18*c* extends from the outer periphery 14 with a portion of the bristle root 20 extending above the first major surface 24 of the hub 12. The first surface 40 of the third bristle 18*c* is coextensive with the protrusion 36 of the hub 12. The third surface 44 of the third bristle 18*c* is coextensive with the recess 38 on the second major surface 26 of the hub 12.

Figure 6:
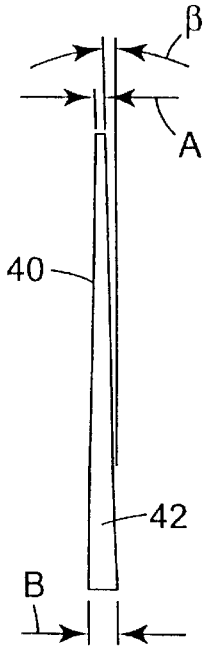
FIG. 6 is a side plan view of the bristle of FIG. 5.
Figure 7:
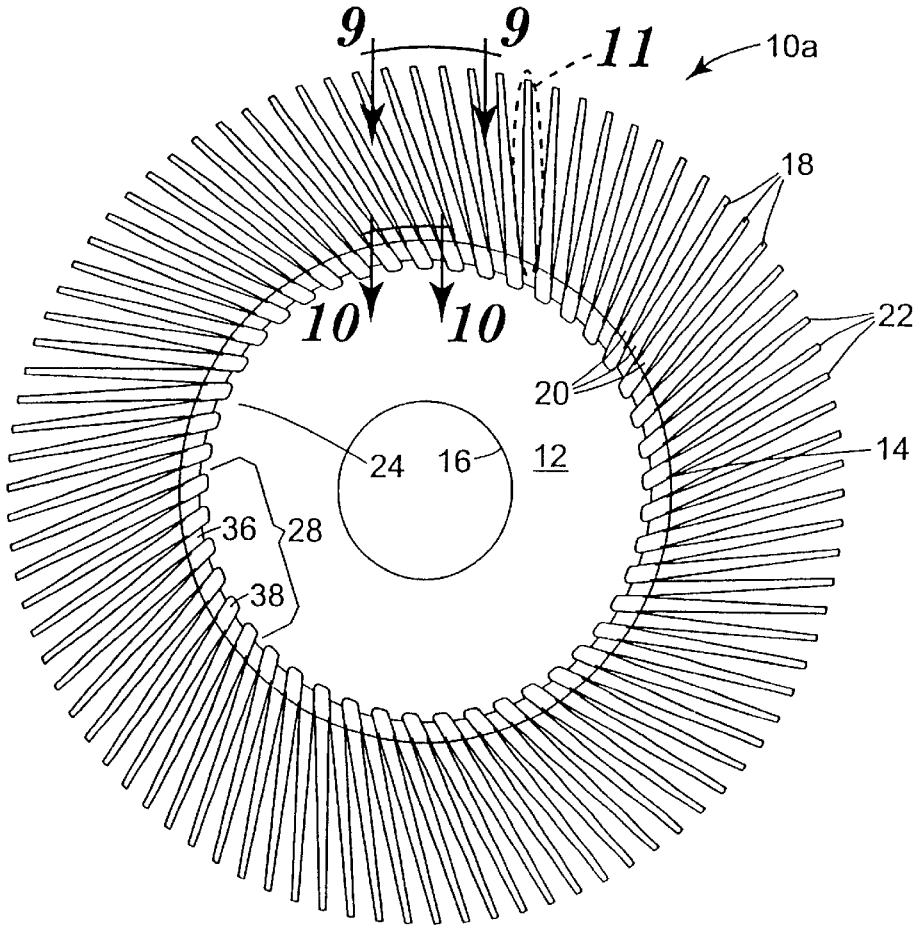
FIG. 7 is a plan view of a second embodiment of an integrally molded brush according to the present invention.

FIGS. 5 and 6 illustrate the taper angles α, β for the bristle 18. The fourth surface 46 of the bristle 18, which is opposite the second surface 42 of the bristle 18 is preferably tapered at the same angle α, however this is not required. Angle α is preferably 0° to 10°. Angle α is more preferably 0.5° to 5°. Angle α is most preferably 1° to 1.5°.

As illustrated in FIG. 6, angle β is the angle between third surface 44 of the bristle 18 and a major surface of the hub 12. The first surface 40 of the bristle 18, which is opposite the third surface 44 of the bristle 18 is preferably tapered at the same angle β, however this is not required. Angle β is preferably 0° to 5°. Angle β is more preferably 0.5° to 3°. Angle β is most preferably 0.1° to 1.2°.

Table 2 includes the dimensions of one preferred embodiment of brush 10 having a diameter of 6 inches (15.24 cm.).

TABLE 2

| A | B | C | D | E | F | diameter of outer periphery | diameter of inner periphery | α | β |
|---|---|---|---|---|---|---|---|---|---|
| 0.02 in. (0.051 cm.) | 0.06 in. (0.15 cm.) | 0.045 in. (0.114 cm.) | 0.06 in. (0.15 cm.) | 1.05 in. (2.67 cm.) | 0.06 in. (0.15 cm.) | 3.60 in. (9.14 cm.) | 2.0 in. (5.08 cm.) | 1.2° | 1.13° |

FIGS. 7–12 illustrate an embodiment of the integrally molded brush 10*a* similar to that shown in FIGS. 1–6, except that bristles 18 are arranged in two rows extending from outer periphery 14 of the hub 12. Bristles 18 may have different preferred dimensions. Such an arrangement allows the bristle tip 22 to be up to 0.030 inches (0.076 cm.) thick.

Figure 8:
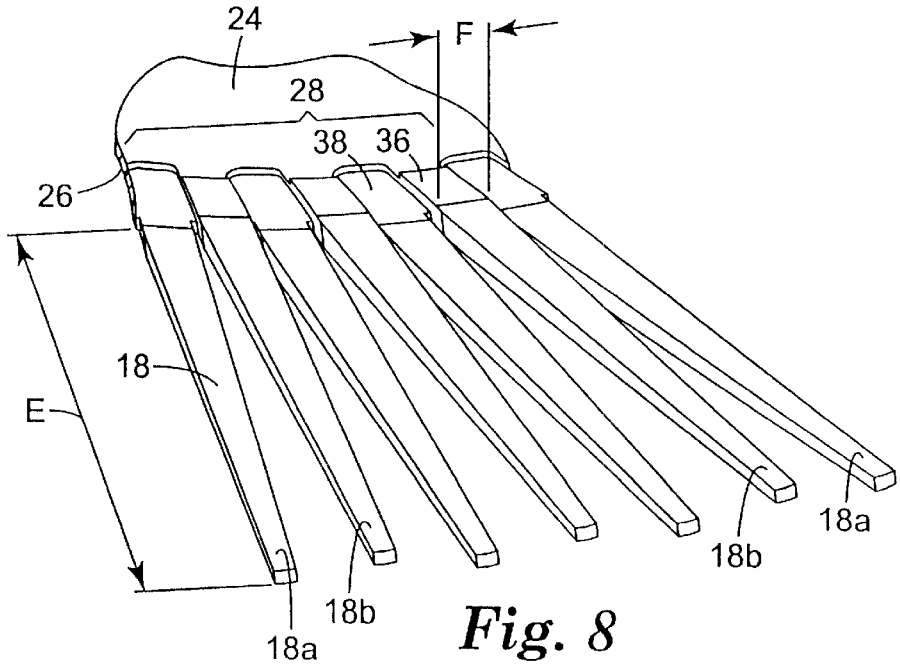
FIG. 8 is an enlarged view of the bristles and hub of the integrally molded brush of FIG. 7.
Figure 9:
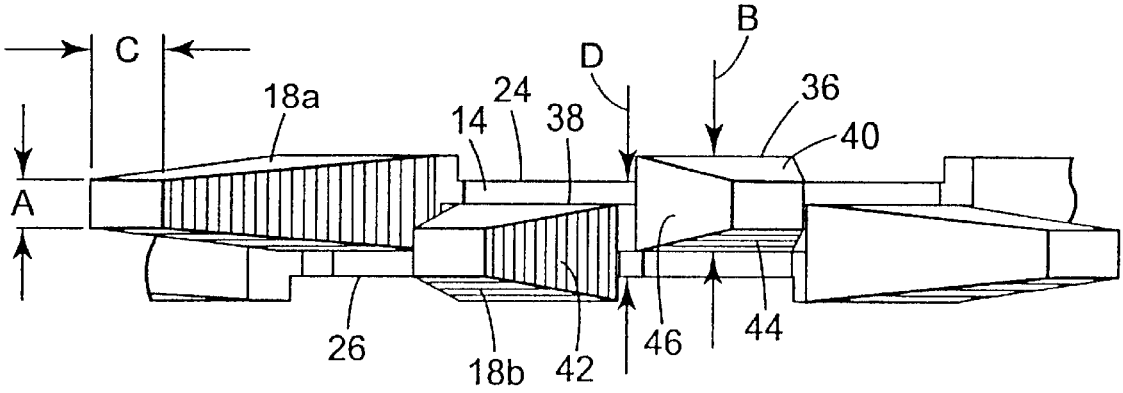
FIG. 9 is a side plan view of the integrally molded brush taken along line 9—9 of FIG. 7.

FIGS. 8 and 9 illustrate one preferred embodiment of hub 12 and bristles 18 of brush 10*a*. Preferably, the outer diameter of brush 10*a* ranges from 6 inches (15.24 cm.) to 8 inches (20.32 cm.) Preferred dimensions for the bristle tip thickness ("A"), bristle root thickness ("B"), bristle tip width ("C"), hub thickness ("D"), bristle length ("E"), bristle root width ("F"), diameter of outer periphery 14, and diameter of inner periphery 16 of brush 10*a* are set forth in Table 1 above.

Figure 10:
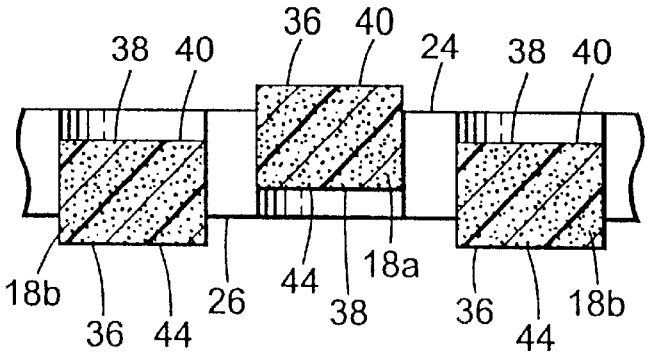
FIG. 10 is a cross-sectional view of the integrally molded brush taken along line 10—10 of FIG. 7.

FIG. 10 is a cross-sectional view of the bristles 18 adjacent the hub 12 of brush 10*a*. The bristles 18 are arranged in two rows across the thickness of the hub 12, as mentioned above. The first bristle 18*a* extends from the outer periphery 14 with a portion of the bristle root 20 extending above the first major surface 24 of the hub 12. The first surface 40 of the first bristle 18*a* is coextensive with the protrusion 36 on the first major surface 24 of the hub 12. The third surface 44 of the first bristle 18*a* is coextensive with the recess 38 on the second major surface 26 of the hub 12. The second bristle 18*b* extends from the outer periphery 14 with a portion of the bristle root 20 extending below the second major surface 26 of the hub 12. The first surface 40 of the first bristle 18*b* is coextensive with the recess 38 on the first major surface 24 of the hub 12. The third surface 44 of the first bristle 18*b* is coextensive with the protrusion 36 on the second major surface 26 of the hub 12.

Figure 11:
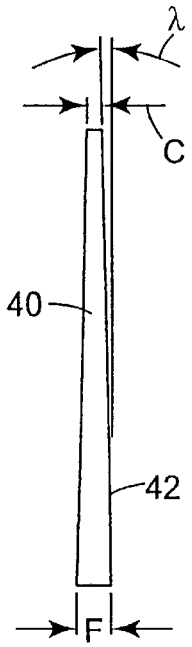
FIG. 11 is a top plan view of a bristle of FIG. 7.
Figure 12:
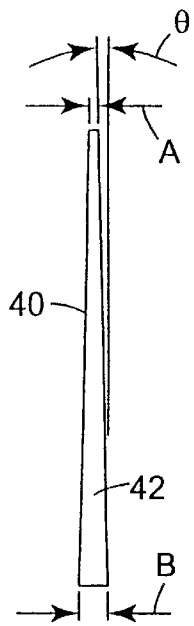
FIG. 12 is a side plan view of the bristle of FIG. 11.

FIGS. 11 and 12 illustrate the taper angles λ, θ for the bristle 18 of brush 10*a*. The fourth surface 46 of the bristle 18, which is opposite the second surface 42 of the bristle 18 is preferably tapered at the same angle λ, however this is not required. Angle λ is preferably 0° to 10°. Angle λ is more preferably 0.5° to 5°. Angle λ is most preferably 1° to 1.5°.

As illustrated in FIG. 12, angle θ is the angle between third surface 44 of the bristle 18 and a major surface of the hub 12. The first surface 40 of the bristle 18, which is opposite the third surface 44 of the bristle 18 is preferably tapered at the same angle θ, however this is not required. Angle θ is preferably 0° to 5°. Angle θ is more preferably 0.5° to 3°. Angle θ is most preferably 0.1° to 1.2°.

Table 3 includes the dimensions of two preferred embodiments of brush 10*a* having a diameter of 6 inches (15.24 cm.). The first embodiment has curved bristles. The second embodiment has straight bristles, with an angle λ of 1.2° and an angle θ of 0.11°.

TABLE 3

| | A | B | C | D | E | F | diameter of outer periphery | diameter of inner periphery |
|---|---|---|---|---|---|---|---|---|
| Curved Bristles | 0.025 in. (0.064 cm.) | 0.055 in. (0.14 cm.) | 0.03 in. (0.08 cm.) | 0.05 in (0.12 cm.) | 1.20 in. (3.05 cm.) | 0.065 in. (0.17 cm.) | 3.75 in. (9.53 cm.) | 2.0 in. (5.08 cm.) |
| Straight Bristles | 0.03 in. (0.08 cm.) | 0.06 in. (0.15 cm.) | 0.045 in. (0.114 cm.) | 0.06 in. (0.15 cm.) | 1.33 in. (3.38 cm.) | 0.108 in. (0.274 cm.) | 3.12 in. (7.92 cm.) | 1.25 in. (3.18 cm.) |

Figure 13:
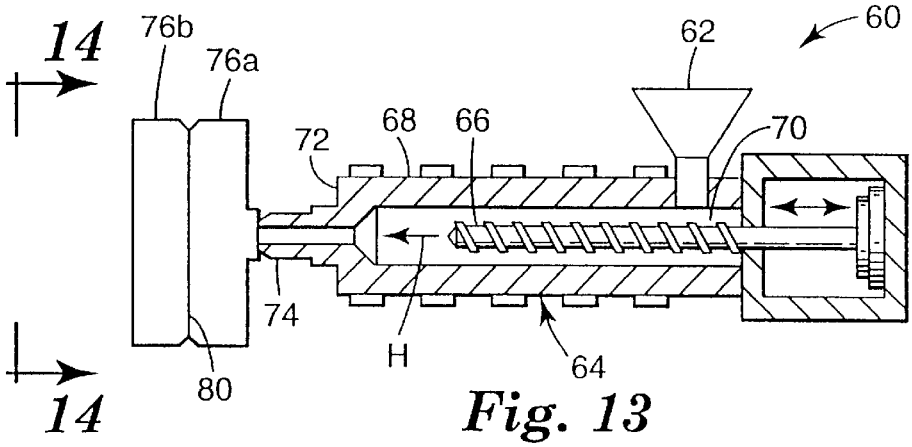
FIG. 13 is a schematic illustration of an apparatus and method for carrying out the present invention.
Figure 14:
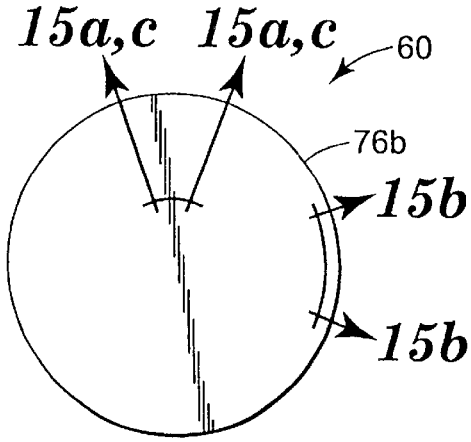
FIG. 14 is an elevational view of the mold of FIG. 13 taken in direction 14—14.

The brushes 10, 10*a* of the present invention are preferably injection molded. Injection molding techniques are known in the art. Injection molding apparatus 60 for making brushes 10, 10*a* according to the method of the present invention is illustrated in FIGS. 13–15. After preferably being dried by heating, a mixture of pellets, comprising a moldable thermoplastic polymer and, optionally, abrasive particles, is placed in hopper 62. The hopper feeds the mixture into a feed zone 70 of a screw injector 64 generally comprising a screw 66 within a barrel 68. The opposite side or front side 72 of screw injector 64 includes nozzle 74 for passing the softened mixture into mold portions 76*a*, 76*b*. Barrel 68 of injector 64 is heated to melt the mixture, and rotating screw 66 propels the mixture in the direction of nozzle 74. When referring to heating the mixture, the abrasive particles may or may not be included in the thermoplastic polymer. Screw 66 is then moved linearly frontward in direction H to impart the "shot" of the softened mixture into mold portions 76*a*, 76*b* at the desired pressure. A gap is generally maintained between the forward end of the screw and the nozzle to provide a "cushion" area of softened material, which is not injected into the mold.

FIG. 14 illustrates an elevational view of the mold. Mold portions 76*a*, 76*b* contain cavities that are the inverse of the desired brush configuration. Mold 76*a*, 76*b* includes a hub portion and a plurality of bristle sections corresponding to the hub 12 and bristles 18 of brush 10, 10*a*. To achieve the brush configuration having a bristle tip thickness of up to 0.030 inches (0.0762 cm.), the mold 76*a*, 76*b* includes a hub portion with a thickness sufficient to allow the molten thermoplastic material to be injected into the thin bristles. For one particular embodiment, it is preferred that the hub section has a thickness of at least 0.050 inches (0.127 cm). More preferably, to achieve a brush configuration having a bristle tips thickness of up to 0.020 inches (0.051 cm.), the mold 76*a*, 76*b* includes a hub portion with a thickness of at least 0.060 inches (0.1524 cm.).

By using a mold with a thicker hub section and a thinner bristle section, the bristle sections may be substantially filled with the thermoplastic polymeric material by maintaining the thermoplastic polymeric material in the hub section at a high enough temperature to prevent solidification of the thermoplastic polymeric material. The present inventors have surprisingly found that as thinner and thinner bristles are molded, there is a limit above which the thickness of the hub must be maintained. For thin bristles, such as thinner than 0.030 inches, the hub must be maintained at a thickness above that of the bristles. If the hub section is too thin, then there is a tendency to draw heat away from the thermoplastic material as it is injected through the hub and then into the bristles. If too much heat is drawn away, then the material may partially solidify before achieving sufficient flow into the bristle cavities. By maintaining the hub section at a sufficient thickness, the material can stay hot enough to flow from the inner periphery, across the hub, and all the way through the bristles. As the bristle length increases at a given taper, this becomes more difficult. If the material is too hot or the mold is too hot, however, then additional time is required to cool the material before the molded brush may be removed from the mold. Such additional time is not desired. Also, if the material is too hot, the material may degrade.

Another parameter that has been found to affect the ability to substantially fill the bristle sections of the mold is the overall diameter for the brush 10, 10*a*, which includes the diameter of the hub 12 and length of the bristles 18. For instance, to achieve a brush configuration with a smaller outer diameter including, for instance, a hub 12 having an outer periphery 14 with a diameter of 1 inch and a bristle length of 1 inch, it may be easier to fill the bristle sections of the mold because the heated thermoplastic polymeric material does not have such a long distance to travel. In contrast, to achieve a brush configuration with a larger overall diameter including, for instance a hub 12 having an outer periphery 14 with a diameter of 4 inches and a bristle length of 2 inches, the heated thermoplastic polymeric material has a greater distance to travel and may be more susceptible to cooling prior to substantially filling the bristle sections of the mold. Preferred overall diameters of the brush 10, 10*a*, are included in the tables above.

The heated thermoplastic polymer is injected under pressure into the mold through a plurality of gates. The gates are in fluid communication with the inner periphery of the hub section of the mold. Preferably, the mold includes six equally spaced gates arranged around the inner periphery of the hub section of the mold and in fluid communication with the hub section of the mold. The number of gates may be increased to provide a more uniform flow of thermoplastic polymer, however this may also increase the amount of wasted material at the gates. These two factors are balanced for selecting the number of gates. Alternatively, it may be possible to use a hot runner system to minimize the waste material at the gates.

The hub section of the mold is in fluid communication with the plurality of bristle sections of the mold. The heated thermoplastic polymer is injected under pressure into the hub section of the mold, while maintaining the thermoplastic polymer at a high enough temperature to prevent solidification of the thermoplastic polymer. The heated thermoplastic polymer flows from the hub section of the mold into the plurality of bristle sections of the mold so as to substantially fill the plurality of bristle sections with the thermoplastic polymer. After injection molding, the mold is cooled to solidify the thermoplastic polymer. The mold halves 76*a*, 76*b* are then separated to allow removal of molded brush 10, 10*a*.

The above mentioned pellets can be preferably prepared as follows. Moldable thermoplastic polymer can be heated above its melting point and the optional abrasive particles, if desired, can then be mixed in. The resulting mixture is then formed into continuous strands and the strands are cooled to solidify the moldable polymer for pelletizing on suitable equipment as is known in the art. Likewise, lubricants and/or other additives to the polymeric material can be included in the formation of the pellets. The pellets comprising moldable polymer, abrasive particles, and any desired lubricant or other additive are then placed into hopper 62 to be fed into screw extruder 64 as described above. Alternatively, it is possible to load abrasive particles and pellets of moldable polymer in the hopper. Lubricants and/or other additives to polymeric material can be mixed in prior to being loaded into the hopper.

Figure 15A:
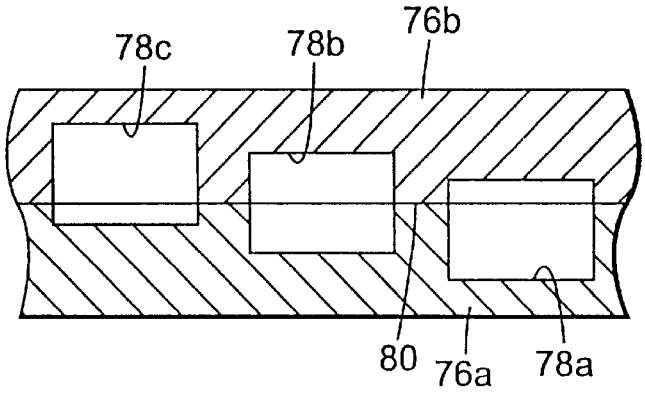
FIG. 15*a* is a cross-sectional view of a first embodiment of the mold portions of FIG. 13, taken along line 15*a*—15*a* of FIG. 14.
Figure 15B:
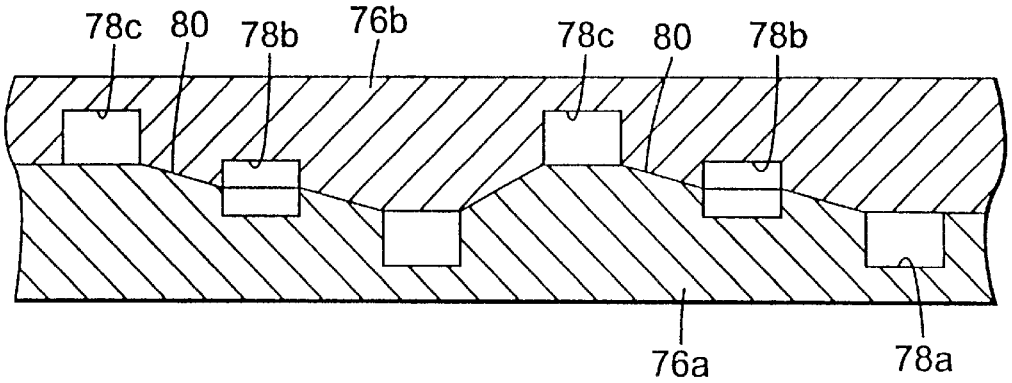
FIG. 15*b* is a cross-sectional view of a first embodiment of the mold portions of FIG. 13, taken along line 15*b*—15*b* of FIG. 14.
Figure 15C:
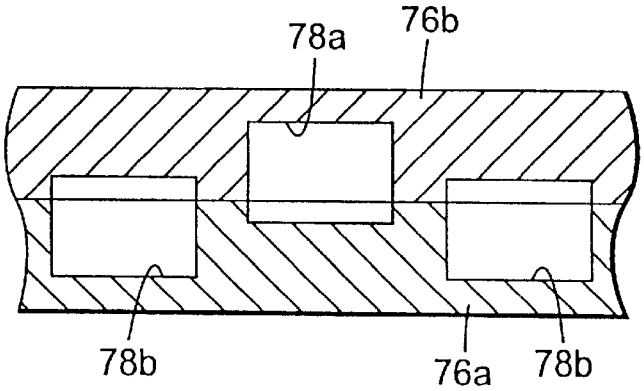
FIG. 15*c* is a cross-sectional view of a second embodiment of the mold portions of FIG. 13, taken along line 15*c*—15*c* of FIG. 14.

As illustrated in FIGS. 15*a*, 15*b*, and 15*c*, mold portions 76*a*, 76*b* include cavities 78 for forming bristles 18. The mold embodiment illustrated in FIGS. 15*a*–15*b* is configured to mold the brush 10 illustrated in FIGS. 1–6. The mold embodiment illustrated in FIG. 15*c* is configured to mold the brush 10*a* illustrated in FIGS. 7–12.

FIG. 15*a* illustrates one preferred embodiment of a mold for molding a brush 10 with three rows of bristles 18. FIG. 15*a* is a cross-sectional view of the mold along the bristle root sections. The mold portions 76*a*, 76*b* contain three cavities 78*a*, 78*b*, 78*c* for molding the bristles 18*a*, 18*b*, 18*c*, respectively. The mold portions 76*a*, 76*b* fit together along parting line 80. Parting line 80 extends through the cavities 78*a*, 78*b*, 78*c* as a straight line.

FIG. 15*b* illustrates another preferred embodiment of a mold for molding a brush 10 with three rows of bristles 18. FIG. 15*b* is a cross-sectional view of the mold along the bristle tip sections. The mold portions 76*a*, 76*b* contain three cavities 78*a*, 78*b*, 78*c* for molding the bristles 18*a*, 18*b*, 18*c*, respectively. The mold portions 76*a*, 76*b* fit together along parting line 80. Parting line 80 extends through the cavities 78*a*, 78*b*, 78*c* as a jagged line.

FIG. 15*c* illustrates another preferred embodiment of a mold for molding a brush 10*a* with two rows of bristles 18. FIG. 15*c* is a cross-sectional view of the mold along the bristle root sections. The mold portions 76*a*, 76*b* contain two cavities 78 and 78*b* for molding the bristles 18*a* and 18*b*, respectively. The mold portions 76*a*, 76*b* fit together along parting line 80. Parting line 80 extends through the cavities 78*a* and 78*b* as a straight line.

The conditions under which the brush is injection molded are determined by the injection molder employed, the configuration of the brush 10, 10*a*, and the composition of moldable thermoplastic polymer and optional abrasive particles. In one preferred method, moldable thermoplastic polymer is first heated to between 70 to 120° C., preferably 80 to 100° C. for drying, and is placed in hopper 62 to be gravity fed into the screw feed zone 70 . The barrel temperature of the screw injector is preferably from about 200 to 260° C., more preferably from about 220 to 245° C. The temperature of the mold is preferably from about 50 to 100° C., more preferably from about 50 to 75° C. The cycle time will preferably range between 3 to 60 seconds, more preferably from about 15 to 25 seconds. The actual plastic pressure at the injection nozzle will preferably range from about 6,895 to 137,895 kPa (1,000 to 20,000 psi), more preferably from about 34,473 to 68,948 KPa (5,000 to 10,000 psi). The injection time will preferably range between 0.5 to 3.0 seconds, more preferably from about 1.0 to 1.5 seconds.

The molded brushes 10, 10*a* are preferably made of a thermoplastic polymeric material. More preferably, the molded brushes 10, 10*a* are made from a thermoplastic elastomer. Brushes 10, 10*a* are most preferably abrasive brushes that include abrasive particles interspersed in the thermoplastic polymeric material.

The molded brushes 10, 10*a* preferably comprise a thermoplastic material, such as thermoplastic polymers and thermoplastic elastomer polymers.

Thermoplastic elastomer polymers include segmented polyester thermoplastic elastomers, segmented polyurethane thermoplastic elastomers, segmented polyamide thermoplastic elastomers, blends of thermoplastic elastomers and thermoplastic polymers, and ionomeric thermoplastic elastomers. Such segmented thermoplastic elastomers are further described in U.S. Pat. No. 5,903,951. Preferred thermoplastic elastomer polymers are segmented polyester thermoplastic elastomers, including those commercially available under the trade designation HYTREL, available from E. I. duPont de Neumors, Wilmington, Del.

The molded brushes may contain abrasive particles. Abrasive particles may be organic, inorganic, or a composite of either organic, inorganic, or both. Abrasive particle composition, concentration, and size are chosen according to the nature of the intended workpiece surface and the desired effect of the molded brush on the workpiece surface. Suitable inorganic particles include those of silicon carbide, talc, garnet, glass bubbles, glass beads, cubic boron nitride, diamond, and aluminum oxide, including ceramic aluminum oxide such as that available under the trade designation CUBITRON from 3M Company, St. Paul, Minn. Suitable organic abrasive particles include those of comminuted thermoplastic polymeric materials. Composite abrasive particles include agglomerates comprising inorganic particles adhered in an organic polymeric binder. Precisely shaped abrasive particles may also be employed. Sizes of abrasive particles may vary from mean particle diameters of less than 1 micrometer to particle mean diameters of up to about half the thickness of the molded brush bristle tip. The concentration of abrasive particles in the molded brushes may vary from zero to more than 50%.

The molded brushes may also contain additives such as lubricants, colorants, coupling agents, compatibilizers, mold release agents, nucleating agents, and the like, as is known in the art.

Abrasive particles and additives may be incorporated into the moldable organic polymer at the time of molding, or alternatively, abrasive particles and/or additives may be compounded with the moldable organic polymer prior to molding. Subsequently, the so-called "masterbatch" can be molded, or mixed with additional moldable organic polymer, or other masterbatches, and then molded.

The preferred dimensions and materials described herein are selected so as to allow molding the brush while maintaining the thermoplastic material at a sufficiently high temperature to fill the mold. With the benefit of the teachings found herein, one of skill in the art could select thicknesses, materials, and temperatures to mold brushes not necessarily falling within the particularly preferred dimensions set forth herein. For example, the hub need not have an inner periphery, but instead could be continuous. The location of the mold gates and thickness of the hub could then be determined with the benefit of the teachings herein.

Further details on configurations of integrally molded brushes and methods of making the same are found in U.S. Pat. No. 5,903,951, "Molded Brush Segment," (Ionta et al.).

The present invention has now been described with reference to several embodiments thereof The foregoing detailed description and examples have been given for clarity of understanding only. No unnecessary limitations are to be understood therefrom. All patents and patent applications cited herein are hereby incorporated by reference. It will be apparent to those skilled in the art that many changes can be made in the embodiments described without departing from the scope of the invention. Furthermore, the sequence of method steps may be selected and changed from the sequence set forth herein. Thus, the scope of the present invention should not be limited to the exact details and structures described herein, but rather by the structures described by the language of the claims, and the equivalents of those structures.

What is claimed is:

1. A method of molding an integrally molded brush, comprising:

a) heating a thermoplastic polymer to sufficiently high temperature to allow the thermoplastic polymer to be injected into a mold;

b) injecting the thermoplastic polymer under pressure into a mold, wherein the mold includes a hub section and a plurality of bristle sections in fluid communication with the hub section and arranged in at least two rows, said bristle sections having a root and a tip, wherein a portion of said roots extend above the first major surface of the hub or below the second major surface of the hub, wherein the hub section includes a thickness of at least 0.05 inches, wherein each of the bristle sections includes a bristle tip section opposite the hub section, and wherein the bristle tip section has a thickness up to 0.03 inches, thereby causing sequential flow 1) into the section of the mold, and 2) into the plurality of bristle sections of the mold so as to fill the plurality of bristle sections with the thermoplastic polymer;

c) cooling the thermoplastic polymer to allow the integrally molded brush to be removed from the mold; and d) removing the integrally molded brush from the mold.

2. The method of claim 1, wherein injecting the thermoplastic polymer includes injecting the thermoplastic polymer into a mold, wherein the mold includes a plurality of gates, and wherein the gates are in fluid communication with the hub section of the mold, and wherein the plurality of bristle sections extend from the hub section of the mold opposite the plurality of gates.

3. The method of claim 1, wherein heating a thermoplastic polymer includes heating a thermoplastic polymer that includes abrasive particles therein to a sufficiently high temperature to allow the thermoplastic polymer to be injected into a mold.

* * * * *

UNITED STATES PATENT AND TRADEMARK OFFICE

CERTIFICATE OF CORRECTION

PATENT NO. : 6,730,140 B2
DATED : May 4, 2004
INVENTOR(S) : Lageson, Kent E. et al.

It is certified that error appears in the above-identified patent and that said Letters Patent is hereby corrected as shown below:

Title page, Item [54] and Column 1, line 2,
Title, delete "OF" and insert in place thereof -- FOR --

Title page,
Item [56], References Cited, OTHER PUBLICATIONS, "Technical Paper" reference, delete "Monofilamanets" and insert in place thereof -- Monofilaments --
Item [57], ABSTRACT,
Line 11, delete "of:" and insert in place thereof -- of; --

Column 1,
Line 8, after "1999" insert -- ,now --

Column 12,
Line 35, delete "1onta" and insert in place thereof -- Ionta --
Line 27, after "thereof" insert -- . --
Line 52, after "comprising" insert -- : --

Signed and Sealed this

Fourteenth Day of December, 2004

JON W. DUDAS
*Director of the United States Patent and Trademark Office*